United States Patent [10]

Béguin et al.

[11] 4,052,842

[45] Oct. 11, 1977

[54] CIRCUIT FOR ELECTRONIC WATCHES

[75] Inventors: Jean-Luc Béguin, Neuchatel; Willy Droz, Hauterive, both of Switzerland

[73] Assignee: Ebauches S.A., Neuchatel, Switzerland

[21] Appl. No.: 644,443

[22] Filed: Dec. 29, 1975

[30] Foreign Application Priority Data

Jan. 31, 1975 Switzerland ..... 1185/75

[51] Int. Cl.[2] ..... G04B 19/30

[52] U.S. Cl. ..... 58/50 R; 58/23 R

[58] Field of Search ..... 58/23 R, 50 R, 58, 855

[56] References Cited

U.S. PATENT DOCUMENTS

| | | | |
|---|---|---|---|
| 3,699,763 | 10/1972 | Zeph | 58/23 R |
| 3,738,099 | 6/1973 | Tanaka | 58/58 |
| 3,772,874 | 11/1973 | Lefkowitz | 58/50 R |
| 3,795,098 | 3/1974 | Fujita | 58/50 R |
| 3,795,099 | 3/1974 | Tsuruishi | 58/23 R |
| 3,838,565 | 10/1974 | Carlyle | 58/50 R |
| 3,910,030 | 10/1975 | Iwade | 58/50 R |
| 3,946,550 | 3/1971 | Fujija | 58/50 R |

*Primary Examiner*—Robert K. Schaefer
*Assistant Examiner*—Vit W. Miska
*Attorney, Agent, or Firm*—Imirie, Smiley & Guay

[57] ABSTRACT

A circuit for electronic watches to enable selection between a 12 hour clock display and a 24 hour clock display. The circuit is driven by the hours counter of a watch and includes a control input for selecting the mode of operation and a logic network having outputs for controlling the display of the tens of hours and, for a 12 hour clock system, for controlling an AM or PM display.

3 Claims, 4 Drawing Figures

CIRCUIT FOR ELECTRONIC WATCHES

BACKGROUND OF THE INVENTION

The present invention relates to a counting device for electronic watches.

There exist two ways of displaying the time. For example, one could count the hours of the day from 1 to 12 and state that it is the morning ("AM" = Ante Meridian) or the afternoon ("PM" = Post Meridian). In Europe, however, one could count from 0 to 23 h. When one wishes, consequently, to make a digital display electronic watch adapted to operate according to the 12 hour clock starting with a circuit designed for the 24 hour clock one can, as has been done, provide an entire new circuit adapted only to display the hours from 1 to 12 and to control a particular display which indicates either AM or PM.

The present invention aims to resolve this problem in a simple manner and enable an easy choice between the two systems.

SUMMARY OF THE INVENTION

According to the present invention there is provided a counting device for electronic digital display watches, comprising a logic circuit connectable to an hour units counter, the said logic circuit having a control input for selecting between a 24 hour clock display and a 12 hour clock display, and outputs, the coding of which is used to control the display of tens of hours and, for a 12 hour clock, to control "AM" or "PM" display segments.

BRIEF DESCRIPTION OF THE DRAWINGS

The present invention will be described further by way of example, with reference to the accompanying drawings, in which.

DETAILED DESCRIPTION OF THE DRAWINGS

Figure 1:
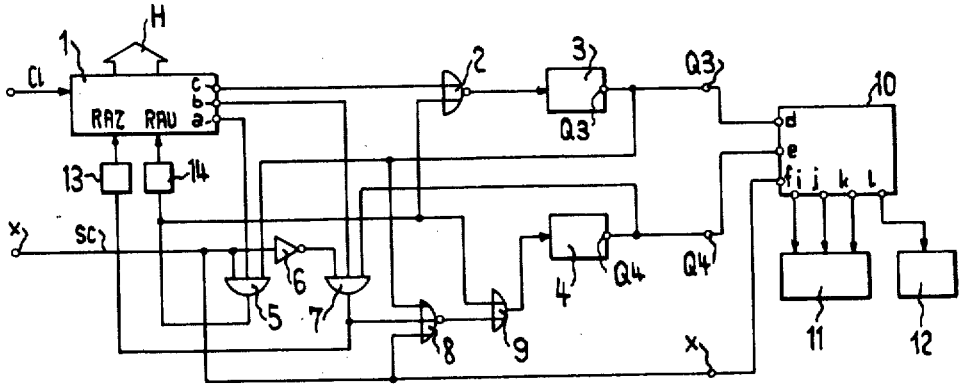
FIG. 1 shows a block diagram of a circuit in accordance with the invention.

In FIG. 1, the counter 1 receives an impulse C1 every hour, which impulse is received from a minutes counter (not shown) of a watch circuit. The output H provided by this counter 1 comprises several lines of coded information which permits displaying the hour units from 0 to 9. This counter 1, moreover, provides three other outputs *a*, *b*, and *c*. The output *a* emits one positive pulse each time that the output H presents the code for the number "2". The output *b* emits one positive pulse each time that the information H presents the code for the number "3", and the output *c* provides a negative-going pulse edge each time that the information H presents a change from "9" to "0". This output *c* can for example deliver a positive pulse each time the information H presents the code for the number "9". The outputs *a* and *b* feed two AND gates 5 and 7 respectively. The output of the AND gate 5 feeds an OR gate 9 and a NOR gate 2. The output of NOR gate 2 feeds a flip-flop circuit 3, the output Q3 of which is connected in turn to one of the inputs of the AND gate 5, to an input of a three input NOR gate 8, and to the input *d* of a logic device 10, described in detail later. The output of the AND gate 7 is connected to a second input of the NOR gate 8, the output of which goes on the OR gate 9. The output of gate 9 feeds a flip-flop circuit 4 the output Q4 of which is connected to, on the one hand the AND gate 7 and, on the other hand, an input *e* of the logic device 10. THe counter 1 has two further inputs, one for returning the count to one, RAU, and the other to returning the count to zero, RAZ. The outputs of the AND gates 5 and 7 are respectively connected via a device 14 to the input RAU, and via a device 13 to the input RAZ. The devices 13 and 14 can be small delay means, emitting a pulse of any duration when their inputs receive a negative-going pulse edge. The device also has an input X, for receiving a control signal SC, which is connected to a third input of the AND gate 5, to the third input of the NOR gate 8 and to the input *f* of the logic device 10. This input X is also connected to a third input of the AND gate 7 via an inverter 6. The logic device 10 has four outputs the first three of which: *i*, *j*, *k* drive a six segment digit display 11 adapted to display the ten of hours, and the fourth output *l*, drives a display system 12 comprising the information AM and PM.

Figure 2:
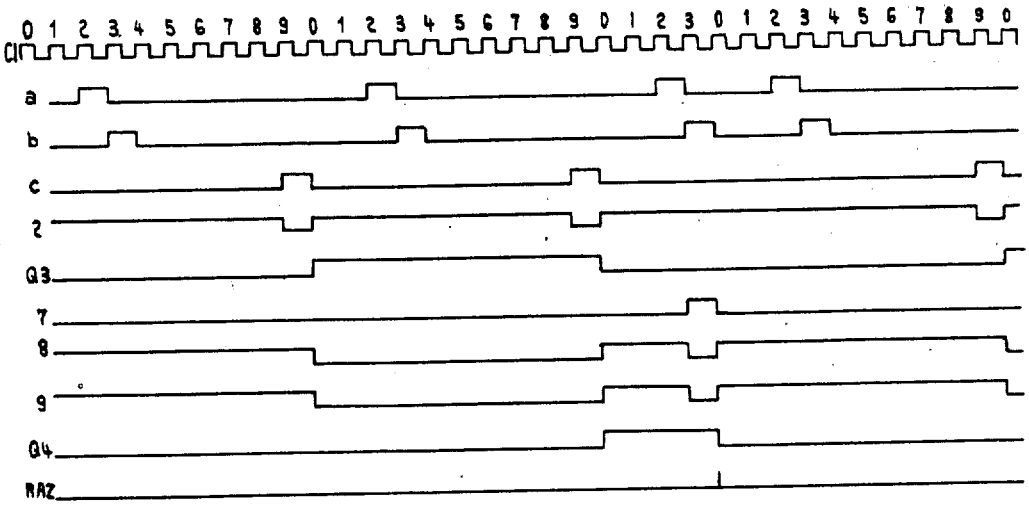
FIG. 2 is a diagram explaining the functioning of the circuit of FIG. 1 for the European method.

In the diagrams of FIG. 2, the clock pulses C1 are shown with, in respect of each pulse, the number information code H. For the European system (24 hour clock) the entry X is at a logic potential "0", which closes the AND gate 5 and permits opening of the AND gate 7. The pulses issuing from the output *c* of the counter 1 could pass, inverted, via the NOR gate 2 and rock the flip-flop circuit 3 which reacts to positive-going pulse edges which it receives. The NOR gate 8, which up to now only had zeros at its inputs and presented a "1" at its output thus blocking the OR gate 9, rocks with the output Q3. When, on the passage "9" to "0", the output Q3 returns to zero, the output of the OR gate 9 presents a positive-going pulse edge which rocks the flip-flop circuit 4. The output Q4 opens the AND gate 7 which will then allow a pulse to pass from the output *b* of the counter 1. This, being inverted in the NOR gate 8, passes the OR gate 9 and, at its positive-going edge (at the end of the pulse), returns the output Q4 to zero. The end of this pulse from the AND gate 7 returns the counter 1 to zero, via the device 13.

The counter 1 has thus functioned normally from 0 to 9 during two decades, and in the third decade, it has been returned to zero after the third hourly pulse C1. The table hereunder indicates the logic state of the outputs Q3 and Q4 for the 24 hours *h* of the day.

| h | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 0 |
|---|---|---|---|---|---|---|---|---|---|---|---|---|---|---|---|---|---|---|---|---|---|---|---|---|---|
| Q3 | 0 | 0 | 0 | 0 | 0 | 0 | 0 | 0 | 0 | 0 | 1 | 1 | 1 | 1 | 1 | 1 | 1 | 1 | 1 | 1 | 0 | 0 | 0 | 0 | |
| Q4 | 0 | 0 | 0 | 0 | 0 | 0 | 0 | 0 | 0 | 0 | 0 | 0 | 0 | 0 | 0 | 0 | 0 | 0 | 0 | 0 | 1 | 1 | 1 | 1 | |

Figure 3:
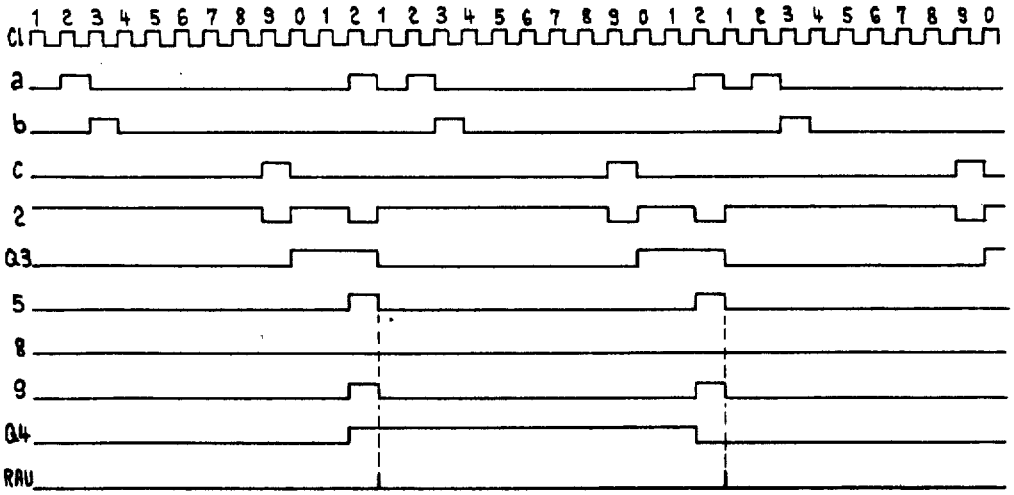
FIG. 3 is a diagram explaining the functioning of the circuit of FIG. 1 for the American method.

FIG. 3 illustrates the functioning of the device for the American system (12 hour clock). The entry X has a logic potential "1" which permits opening of the AND gate 5 and closing of the AND gate 7. The pulses issuing from the output *c* of the counter 1, at the end of a first decade, rock the flip-flop circuit 3. The output Q3 of this flip-flop 3 opens the AND gate 5, however, so that in the following decade, at the end of the pulse issued from the output *a* of the counter 1, this counter will be returned to one, via the device 14, which is identical to the device 13. The negative-going edge of this pulse from the output *a* transmitted via AND gate 5 and inverted in the NOR gate 2, causes the flip-flop circuit 3 to return to "0", whilst at the beginning of the pulse, which passes via tthe OR gate 9, the flip-flop circuit 4 is rocked. At the end of the decade which has restarted at one, the flip-flop circuit 3 returns to one, then returns to zero at the second unit of the following decade, whilst the flip-flop circuit 4 returns to zero. Below a table illustrates the state of the outputs Q3 and Q4 of the flip-flop circuits 3 and 4 for the 2 × 12 hours *h* of the day.

| h | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 |
|---|---|---|---|---|---|---|---|---|---|---|---|---|---|---|---|---|---|---|---|---|---|---|---|---|
| Q3 | 0 | 0 | 0 | 0 | 0 | 0 | 0 | 0 | 0 | 1 | 1 | 1 | 0 | 0 | 0 | 0 | 0 | 0 | 0 | 0 | 0 | 1 | 1 | 1 |
| Q4 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 0 |
| | | | | | | AM | | | | | | | | | | | | PM | | | | | | AM |

Figure 4:
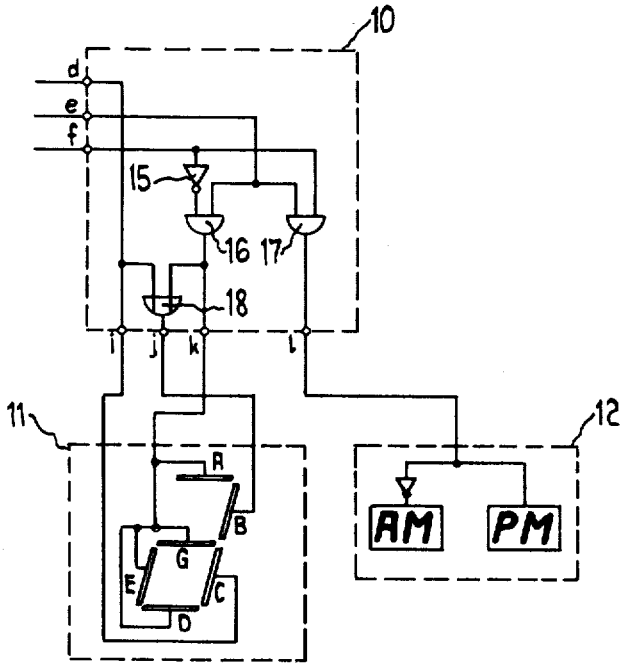
FIG. 4 shows a detail of FIG. 1.

In FIG. 4, one can see in detail the devices 10, 11 and 12 of FIG. 1. The logic device 10 comprises an inverter 15, two AND gates 16 and 17 and an OR gate 18. It constitutes a transcoder between the information furnished by the inputs *d* (which corresponds to the output Q3), *e* (which corresponds to the output Q4) and *f* (which corresponds to the input X) and the display device for the tens of hours 11, comprising six segments (A, B, C, D, E and G), and the display device 12 for the AM, or PM segments. The output *i* of the device 10 drives the segment C, the output *j* drives the segment B, and the output *k* drives the segment A, D, E and G. The output *l*, drives the AM and PM segments, and is only connected to these segments in the case where one desires to have functioning in the American system.

It is easy to establish for the two systems, from the information given in the two tables which follow, the display which one obtains for the different parts of the day.

| Hour of the day | European Method f(X) | d(Q3) | e(Q4) | Display tens of hours |
|---|---|---|---|---|
| 0–10 h | 0 | 0 | 0 | — |
| 10–20 h | 0 | 1 | 0 | 1 |
| 20–24 h | 0 | 0 | 1 | 2 |

| Hour of the day | American Method f(X) | d(Q3) | e(Q4) | Display tens of hours | Segment AM-PM |
|---|---|---|---|---|---|
| 1–10 h | 1 | 0 | 0 | 0 | AM |
| 10–12 h | 1 | 1 | 0 | 1 | AM |
| 12–13 h | 1 | 1 | 1 | 1 | PM |
| 13–22 h | 1 | 0 | 1 | 0 | PM |
| 22–24 h | 1 | 1 | 1 | 1 | PM |
| 24– 1 h | 1 | 1 | 0 | 1 | AM |

We claim:

1. An electronic timepiece having a digital display, an AM-PM indicator, an hour units counter, and means to enable selection by way of a control input between a 24 hour clock display mode and a 12 hour clock display mode, the improvement wherein said selection means comprises a first and a second flip-flop circuit, a decoder circuit coupled between outputs of said flip-flop circuits and a digital display and AM-PM indicator for driving said display and indicator, and logic means coupled with the counter and said flip-flop circuits and responsive to the control input for interconnecting said flip-flop circuits to form a counter for the tens of hours when said 24 hour clock display mode is selected, and for connecting said first flip-flop circuit to count the tens of hours and said second flip-flop circuit to control the AM-PM indicator when said 12 hour clock display mode is selected.

2. An electronic timepiece according to claim 1, wherein said logic means comprises:

a first three-input AND gate, the inputs of which are connected in turn to said control input, to an output of said first flip-flop circuit and to a first output of said hour units counter, said first output of said counter delivering one pulse at a logic potential "1" each time when said hour units counter is at a logic state corresponding to the number "2";

a second three-input AND gate, the inputs of which are connected in turn through an inverter to said control input, to the output of said second flip-flop circuit and to a second output of said hour units counter, said second output of said counter delivering one pulse at a logic potential "1" each time when said hour units counter is at a logic state corresponding to the number "3";

a three-input NOR gate, the inputs of which are connected in turn to the output of said first flip-flop circuit, to the output of said second AND gate and to said control input;

a two-input OR gate, the inputs of which are connected in turn to the output of said first AND gate and to the output of said NOR gate, the output of said OR gate being connected to the input of said second flip-flop circuit; and a two-input NOR gate, the inputs of which are connected in turn to the output of said AND gate and to a third output of said hour units counter, said third output of said counter delivering one pulse at a logic potential "1" each time when said hour units counter is at a logic state corresponding to the number "9", the output of said NOR gate being connected to the input of said first flop-flop circuit.

3. An electronic timepiece according to claim 2, wherein said decoder circuit comprises:

a two-input AND gate, the imputs of which are connected in turn to the output of said second flip-flop circuit and through an inverter to the control input; and a two-input OR gate, the inputs of which are connected in turn to the output of said first flip-flop circuit and to the output of said two-input AND gate, the output of said two-input AND gate coupled to drive vertical segments and a lower left segment of a six-segment digital display for the tens of hours digit, the output of said decoder OR gate coupled to drive an upper right segment of said digital display, and the output of said first flip-flop circuit coupled to drive a lower right segment of said digital display.

* * * * *